US008672074B2

(12) United States Patent
Ganeous

(10) Patent No.: US 8,672,074 B2
(45) Date of Patent: Mar. 18, 2014

(54) APPAROCYCS

(76) Inventor: Marcus Mark Henry Ganeous, Rockville, MD (US)

( * ) Notice: Subject to any disclaimer, the term of this patent is extended or adjusted under 35 U.S.C. 154(b) by 0 days.

(21) Appl. No.: 13/506,929

(22) Filed: May 25, 2012

(65) Prior Publication Data

US 2012/0325567 A1 Dec. 27, 2012

Related U.S. Application Data

(60) Provisional application No. 61/457,816, filed on Jun. 9, 2011.

(51) Int. Cl.
*A63C 5/08* (2006.01)

(52) U.S. Cl.
USPC ..... 180/181; 280/841; 280/844; 280/11.115

(58) Field of Classification Search
USPC ..... 180/181; 280/841, 844, 11.115
See application file for complete search history.

(56) References Cited

U.S. PATENT DOCUMENTS 2,857,008 A * 10/1958 Pirrello ..... 180/181
3,876,032 A * 4/1975 Ferino ..... 180/181
4,546,841 A * 10/1985 Sipiano ..... 180/181
5,236,058 A * 8/1993 Yamet et al. ..... 180/181
5,390,958 A * 2/1995 Soo ..... 280/844
5,730,241 A * 3/1998 Shyr et al. ..... 180/181
5,797,466 A * 8/1998 Gendle ..... 180/181
5,829,543 A * 11/1998 Diaz ..... 180/181
6,059,062 A * 5/2000 Staelin et al. ..... 180/181
7,383,908 B2 * 6/2008 Tuli ..... 180/181
2005/0082099 A1 * 4/2005 Tuli ..... 180/181
2008/0061521 A1 * 3/2008 Ng et al. ..... 280/11.115
2008/0217084 A1 * 9/2008 Tuli ..... 180/181
2010/0071652 A1 * 3/2010 Almhagen et al. ..... 123/185.14
2013/0025955 A1 * 1/2013 Chavand ..... 180/181
2013/0119622 A1 * 5/2013 Othman ..... 280/11.115

FOREIGN PATENT DOCUMENTS

WO WO 01/87436 A1 * 11/2001 ..... A63C 17/12
WO WO 2010138987 A1 * 12/2010 ..... F41B 9/00

* cited by examiner

*Primary Examiner* — J. Allen Shriver, II
*Assistant Examiner* — Conan Duda
(74) *Attorney, Agent, or Firm* — Michael L. Greenberg, Esq.; Greenberg & Lieberman, LLC

(57) ABSTRACT

A non-conventional motorcycle designed to be a wearable application. It is intended that the present invention is used to transport a passenger commuting between a suburb and a city which lack a reliable public means of transportation to school, work or other, however it is more particular, that the present invention be used in extreme, sport competition racing of various applications providing an area facilitating spectators.

3 Claims, 14 Drawing Sheets

10
200
64
153
92
86a
80
88a
37a
76
72
88c
50
79
51
129
45a
145
144
90
150
152
151
73
26
128
148
149
130
40
107a
132
75
146
100
99
134
62
48
74
101
110
96
69
69
69
69
69
69
68
49
108
97c
97a
19a
124
131b
131a
122
123
120
119
90
90
53
54
42
84
59A
58
141
142
30
20
105a
126
125
136
143
144
145
129
51
45a
79
88c
50
37a
86a
80
88a
153
64
92
76
72

APPAROCYCS

FIELD OF THE PRESENT INVENTION

The present invention relates to compact motorcycles. More particularly, the invention relates to a wearable motorcycle application.

BACKGROUND OF THE PRESENT INVENTION

Motorcycles have been a convenient part of transportation since the early or mid 1800's. Historically, they've been used to travel the roadways all over the world displaying their trendy looks, shear power and extreme exhilaration over the passenger(s) straddled upon its affixed seat(s).

Many variations in designs, functions and configurations have been invented through the years, ranging from two, three or four wheeled models. Also, a single wheeled version reflects on this prior art.

The typical motorcycle application comprises, an operative framing portion, connected to a power source via (internal combustion engine, electric motor or other) with an affixed seat(s) in which the passenger(s) must straddled in order to operate the vehicle.

Furthermore, motorcycles innovative designs have spawned the conception of many other similar applications; such as snowmobiles, jetskis, mini-bikes, scooters and the list goes on but still they share the same comprising applications, it must be straddled via a seat(s).

With all that has been discussed, motorcycle's basic designs hasn't changed much in the last couple of hundred years. It still comprises the same rudimentary features, as originally designed upon which conceptionally derives from a bicycle with an affixed engine onto the operative frame system of the earlier years; except power delivery and number of wheels, has been change.

Conventional motorcycles of the current era still comprise an upright frame system, having an operative front and rear frame portion via steering assembly, an affixed seat(s), a power source (internal combustion engine, electric motor or other) and wheels; normally equally one or two at the operative front frame portion and either one or two and the rear frame portion.

In most application, if not all, riding the vehicles requires a passenger to sit atop an affixed seat while starting the engine, accelerating the vehicle via throttle assembly connected onto the handlebars end portion and the passenger directs the vehicle's path via steering assembly (handlebars) on a road surface, until finally bringing the vehicle to a stop via braking systems by pressing a lever affixed onto the handlebars end portion, inward a rubber throttle grip assembly or pressing down on a foot braking pedal.

Needless to say, the design, delivers the same riding experience as in the past over the passengers, despite the simple change in the number of wheels or how much power the engine produces. What is needed to improve upon this revolutionary design, lies within changing the way the application is ridden in relation to the passenger's anatomy; not in a bigger engine or adding a fifth wheel.

BRIEF SUMMARY OF THE INVENTION

The present invention provides a non-conventional motorcycle designed to be a wearable application. It is intended that the present invention is used to transport a passenger commuting between a suburb and a city which lack a reliable public means of transportation to school, work or other, however it is more particularly, that the present invention be used in extreme, sport competition racing of various applications providing an arena facilitating spectators. The invention described herein depicts compact, twin motorcycles which are designed to be strapped beneath the passenger's feet, similar to wearing a pair of shoes, skates or skis; opposed to conventional applications where the passengers straddle a seat to perform the operation of riding the vehicle. Contrary to sitting down upon a seat of conventional motorcycles and controlling direction via handlebars; the present invention is ridden entirely in the standing position. Whenever the passenger chooses to change direction, he or she must simultaneously twist the hip, legs and feet in desire direction, then the vehicle's operative frame systems respond by pitching in that direction. Conventional motorcycles generally carry the passenger's weight supported by an operative frame which is supported with (2-4) wheels and a single power source (internal combustion, electric motor) to the contrary the present invention is designed to convey the passenger's weight atop a pair of reinforced rubber tracks, supported by a series of different diameter driving pulleys connected onto the operative frame systems that support the power source (internal combustion, electric motor) which forces the tracks to rotate around the entire system of pulleys, thus, propelling the passenger forward on a road surface. Furthermore, conventional motorcycles are outfitted with anesthetic, aerodynamic fairings and body panels to alter the performance levels, protect the rider from wind blast, and conceal electrical components. However, with the present invention the fairings and body panels are molded as a single full body panel, structured in pairs to which encapsulate the passenger's feet and ankles as a protection application and support system. The full body panels of the present invention are also structured with aerodynamic body surfaces to enhance performance levels, conceal electrical components, support fuel tank and light assembly. Furthermost, the full body panels of the present invention serves primarily as a steering apparatus for the vehicle's operative frame systems. Conventional motorcycles rely on a handlebar to steer the vehicles when the passenger desires to turn in a given direction; he or she twists the handlebars to perform the turn. With the present invention the full body panels are twisted by the passenger's feet, legs and hip to turn the operative front frame systems on a different, 'pivot' axis then the rear frame systems' primary axis, thus, turning the vehicles. The present invention described herein, comprises various electronic and manually controlled starter systems currently used on conventional motorcycles of today. The passenger uses a switch to control the ignition systems via a key or push-button application; other such starting systems applications incorporate a modified kick-starter system, in which the operator or passenger must switch on the engine's ignition system via targo switch or other, before using either foot to kick the surface area portion of the belt (track) system atop a road surface to turn over or rotate the drivetrain assembly thus manually starting the vehicle's engines via mechanical clutch systems. Conventional motorcycles generally use an acceleration system comprising a hand control, throttle grip assembled at the end point of the handlebar in which the rider must twist the hand control (throttle) forward to accelerate the vehicle; however, with the present invention the passenger accelerates the vehicles by the action of leaning or crouching in a forward posture which engages the acceleration systems affixed via throttle cables or leakage systems connected onto the operative feet rigging supports which is suspended onto the base of the main support platform structured within the interior of the full body panels and to decelerate the passenger returns to an upright posture, simultaneously activating the self-braking mechanisms to slow down or stop the vehicles, completely. Contrary to conventional motorcycle brake applications in which the passenger, squeezes a hand lever on the handlebar or applies pressure onto a foot pedal to slow down or stop the vehicle, however the present invention comprises operative feet rigging supports which act as a lever device to engage the brake systems, as the passenger begins to reposition the feet to the initial, upright posture, thus slowing down or stopping the vehicles, completely. Furthermost, the present invention described herein can be adapted to many other conventional hand control systems (electronic or other) to manage the vehicles, brakes systems and fuel management systems.

DETAILED DESCRIPTION OF THE PREFERRED EMBODIMENTS

Figure 1:
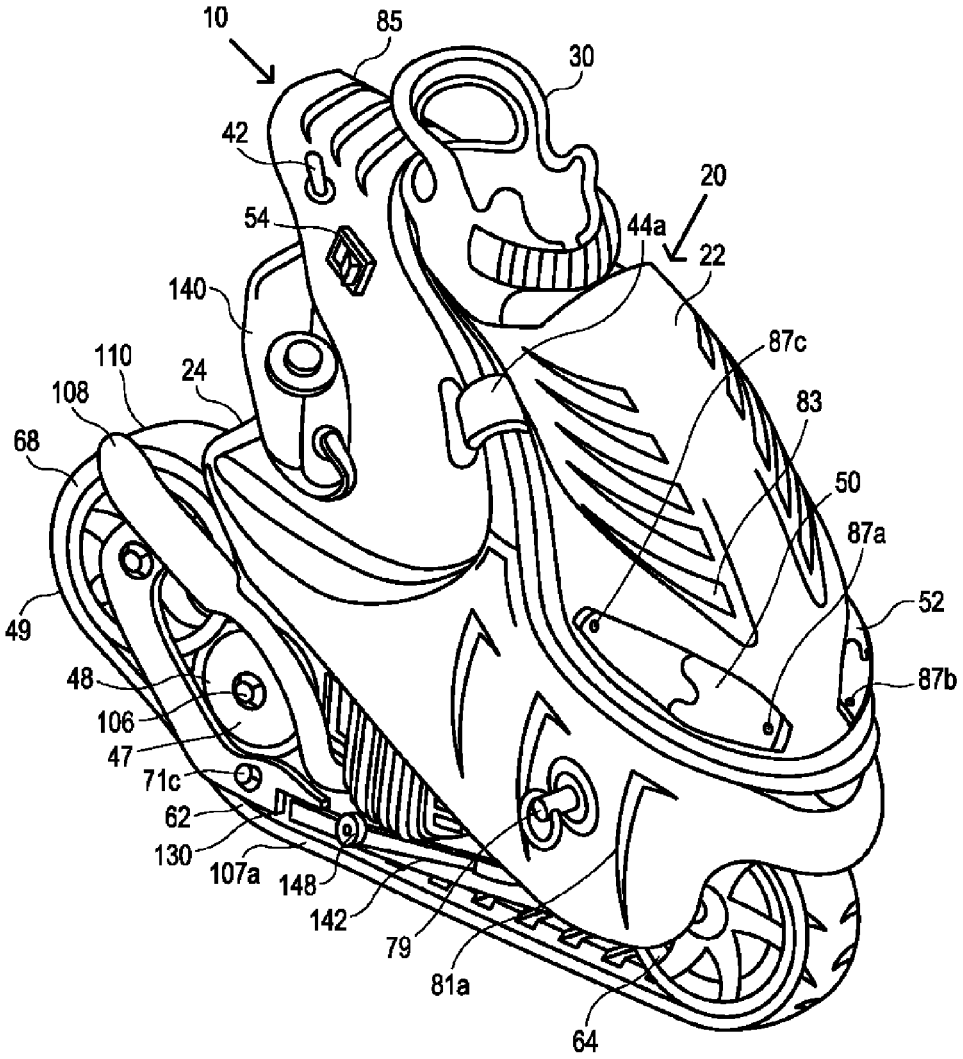
FIG. 1 is a (right) perspective side view of the present invention, illustrating the components that make up the preferred embodiments.
Figure 2:
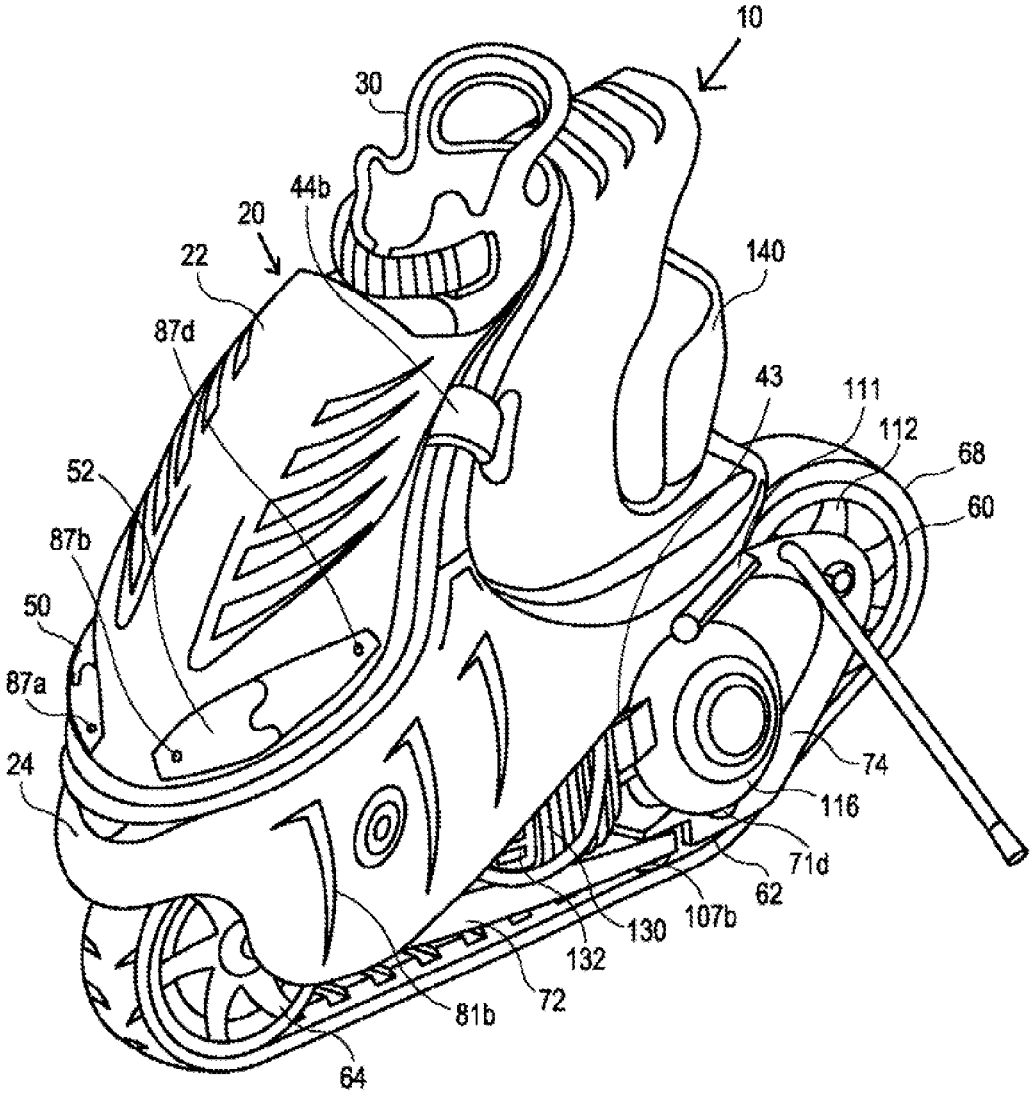
FIG. 2 is a (left) perspective side view of the present invention, illustrating the components that make up the preferred embodiments.
Figure 3:
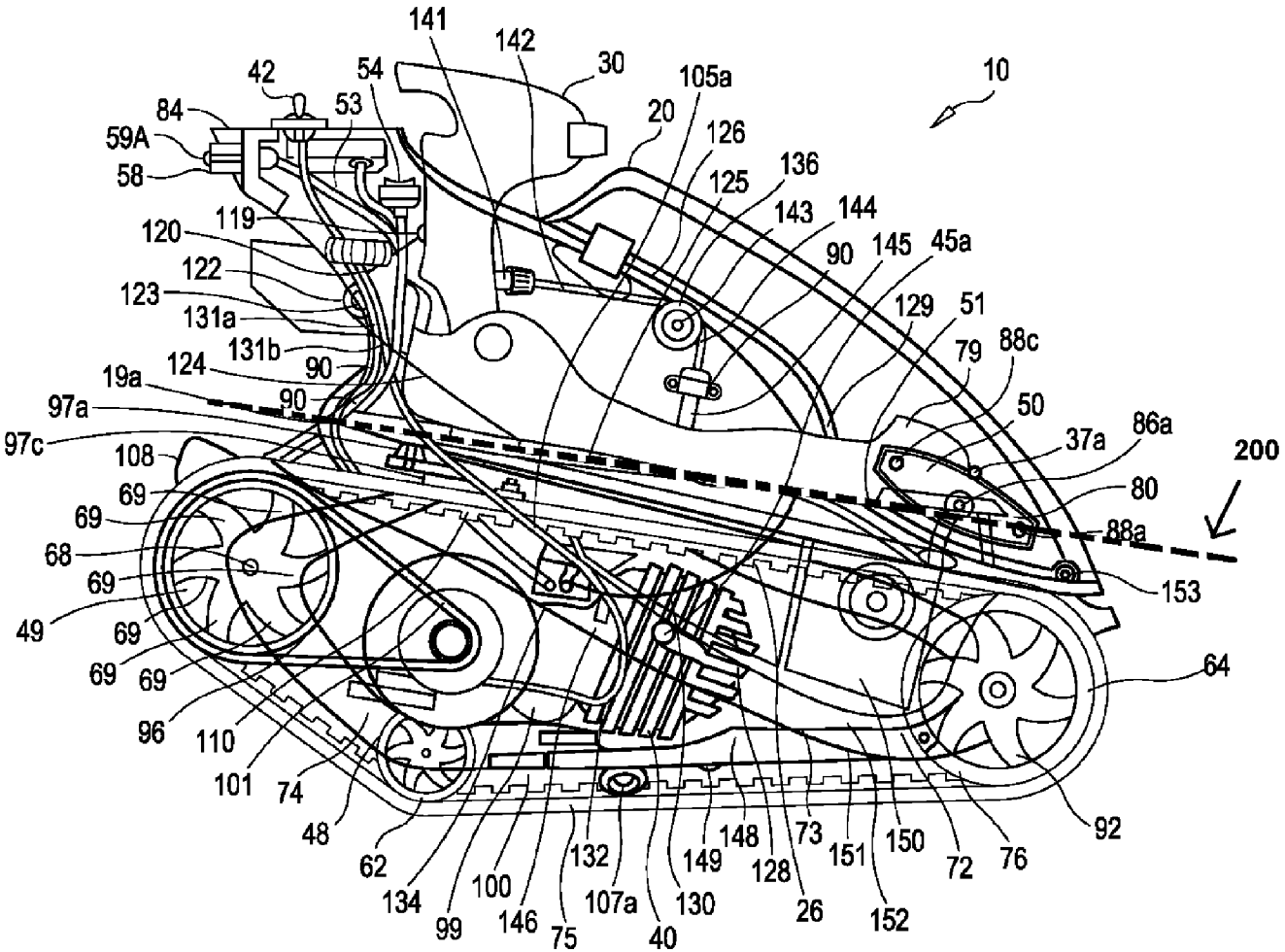
FIG. 3 is a (right) elevational view of the present invention, illustrating the internal components and how the present invention functions.
Figure 4:
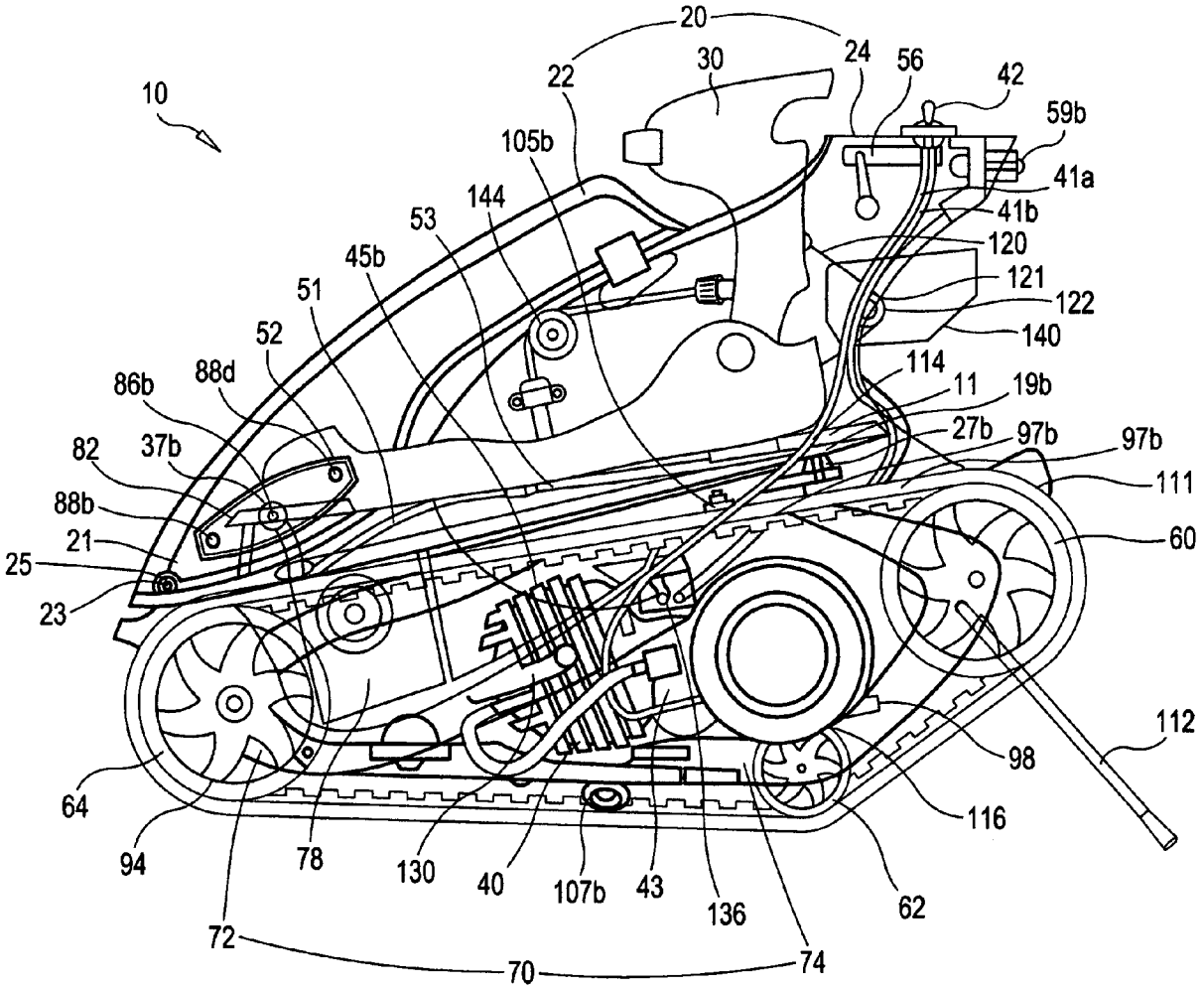
FIG. 4 is a (left) elevational view of the present invention, illustrating the internal components and how the present invention functions.
Figure 5:
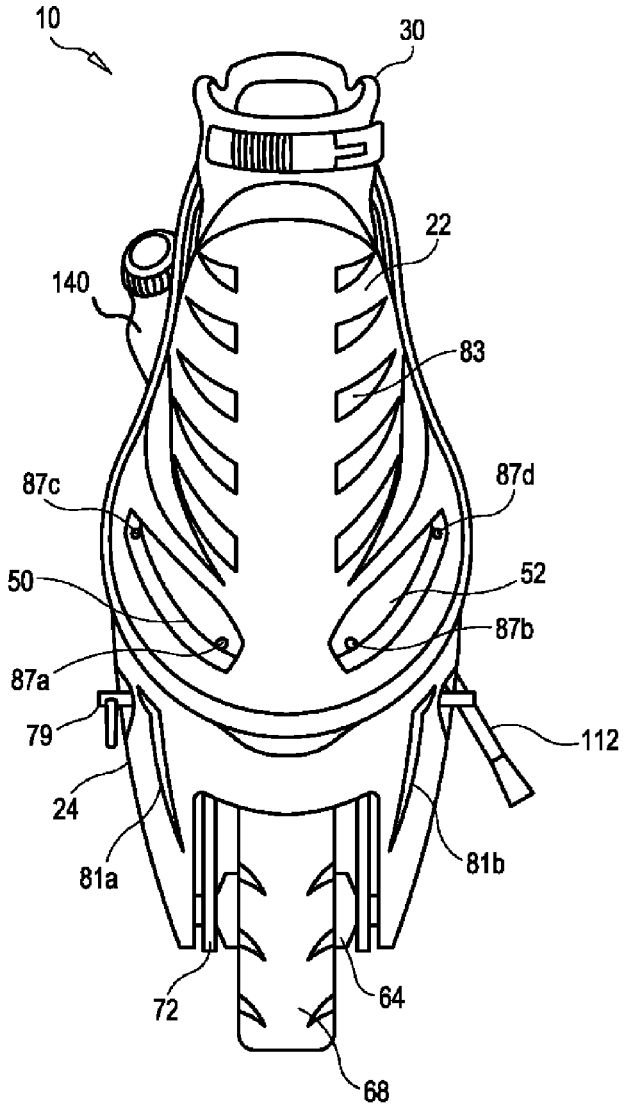
FIG. 5 is a front elevational view of the preferred embodiments of the invention, illustrated in FIGS. 1-4.
Figure 6:
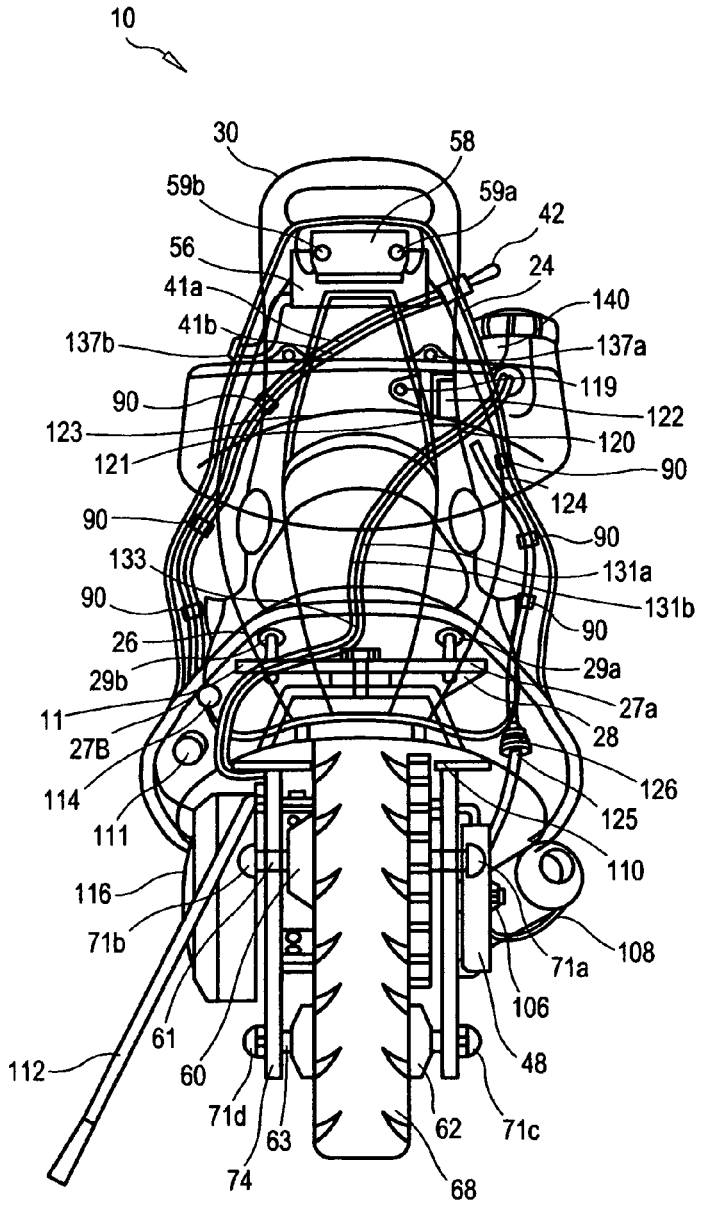
FIG. 6 is a rear elevational view of the preferred embodiments of the invention, illustrated in FIGS. 1-5.
Figure 7:
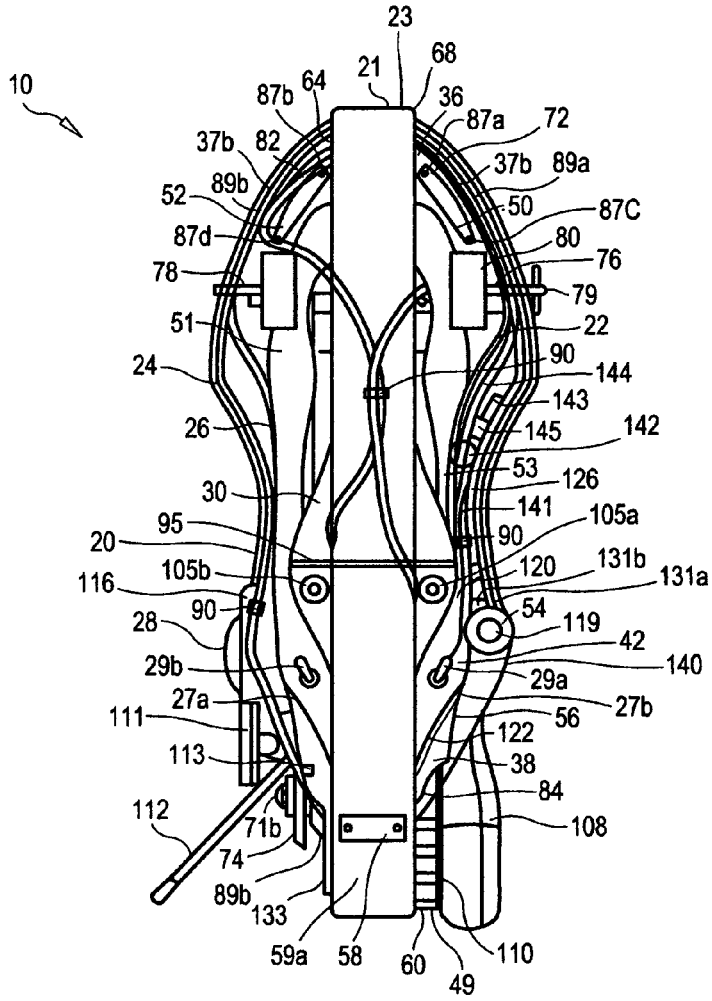
FIG. 7 is a top view of the present invention, showing the internal components and how the present invention functions, illustrated in FIGS. 1-6.

FIGS. 1-14 illustrate the wearable motorcycles (10), in accordance with the preferred embodiments of the present invention; having wearable motorcycles (10), comprising; a first vehicle (10) for the left foot and a second duplicate vehicle (10) for the right foot (not shown). All the structures and mechanisms for each one of two wearable motorcycles (10), is identical with the exception of having an affixed conventional plastic, operative left support boot (30) and a plastic, operative right support boot (30) (not shown); so only one of the two wearable motorcycles (10) will be described.

The wearable motorcycle (10) (FIG. 1-4,9) comprise, a molded, light-weight aerodynamically structured, modular full body panel (20), having a front end, rear end, left side and right side which is constructed in two segmented body portions, providing a first portion, fuselage hatch (22) and a second portion fuselage (24) which together form the full body panel (20). Fuselage hatch (22) has a (male) hinge-half (21) on the front, interior end which is inserted between a (female) hinge-half (23) on the front, interior end of the fuselage (24) and are secured together via a hinge-pin (25), that enables the fuselage hatch (22) to be opened or closed around a passenger's foot during usage of the vehicle (10). Also, fuselage hatch (22) is equipped with plastic latches (44) a, b and c, d (not shown) to lock the fuselage hatch (22) onto the fuselage's compartment opening.

The modular full body panel (20) (FIGS. 1-14) of the vehicle (10) are constructed of mated reinforced, light-weight fiberglass in this configuration of the preferred embodiment of the present invention, however other such light-weight construction materials could include: carbon fiber, plastic or other (not shown), as alternatives.

Another aspect of the aerodynamic form, implemented into the full body panel (20) (FIGS. 1-2, 9) provides vented louver (81*a*), scored into the right side of the fuselage and scored vented louvers (81*b*) into the left side of the fuselage (24), also having vented louvers (83) scored into surface of fuselage hatch (22) and scored louvers (85) into the rear end surface of the fuselage (24) which channels the air-flow, induced by traveling on the vehicles (10), that passes over and through the full body panel (20) to distribute cool filtered air to the internal combustion engine (40).

The fuselage hatch (22) (FIG. 1-4, 7) is formed with two recessed ports, providing milled, centered, holders (86*a*) and (86*b*) in each port which are located at the front end portion of the fuselage hatch (22). There is a right port (80) to support a right front exterior light (50) and a left port (82) to support a left front exterior light (52) and both exterior lights are attached to the hatch (22) via assembly screws (87*a, b, c, d*) which are secured within each of the exterior light's corner edges, through assembly holes (88*a, b, c, d*) which are milled directly into the fuselage hatch (22).

A first insulated (Y) shaped wire lead (51) is fastened to the underside of the main support platform (26) via a plurality of plastic body clips (90), having two of three connective ends, inserted through inlets (89*a* and 89*b*) within the front portion of the main support platform (26) and are connected onto the bases of the exterior lights (50, 52) to supply illumination to the front end of the vehicle (10) from a power source. The wire lead (51) also connects to a second insulated wire lead (53) at the latter end of lead (51), that is routed from the rear interior of the fuselage (24) which supports a rear exterior light (58) within a recessed port (84) via assembly screws (59*a*, 59*b*), securing it to the port (84). Insulated wire lead (53) first connects to the base of the rear exterior light (58) intricately, extends to a rechargeable battery (56) power source, stored at the interior rear end of the fuselage (24) and further extending to a single power control switch (54) which is secured to the rear exterior of the fuselage (24), as well.

The main support platform (26) (FIGS. 3-4, 14) is a part of the fuselage (24) to which supports the weight of a passenger while riding about on the vehicles (10), in this preferred embodiment of the present invention. Another aspect of the main support platform (26) provides a means of supporting and anchoring an operative, left support boot (30), a passenger wears inside of the full body panel (20) to provide additional support for a passenger's feet and ankles, also to implement as a control device while riding the vehicle (10).

The operative left support boot (30) (FIG. 3-4, 7) secures to the main support platform (26) via a forged aluminum heel cleat (38) and a forged aluminum toe cleat (36) attached onto the sole of the left boot (30) by a succession of riveting fasteners (39) (FIGS. 10-11) and is movably affixed onto the main support platform (26), enabling the heel cleat (38) to be wedged in between the interior, rear portion of the main support platform (26) and the interior, rear body portion of the fuselage (24), also having the toe cleat (36) secured to the front base portion of the main support platform (26) via self-locking anchors (37*a*, 37*b*) which are structured into the main support form (26) that insert into anchor holes (35*a*, 35*b*) in toe (36) to pin-down the left support boot (30) to the main support platform (26).

The full body panel (20) (FIGS. 1-4, 7-8) operatively connects to a forged aluminum frame system (70) comprising, a front frame member (72), pivotally linked to a rear frame member (74) and the two frame members together make up the frame system (70). The front frame member (72) assembles onto the fuselage (24) via a self-locking, front assembly shaft (79) which is inserted through a center hole (91*a*) supplied in a front (right) rubber dampener (76) that is embedded within the fuselage's (right) interior weld (92) which passes through a first assembly hole (93*a*) in the (right side) of the front frame member (72), clear through to a second assembly hole (93*b*) supplied in the (left side) of the front frame member (72) and finally, inserted through a second center hole (91*b*) supplied in the front (left) rubber dampener (78), embedded within the (left) interior weld (94) having the front assembly shaft (79) locked in place, securing the fuselage (24) onto the front frame member (72) by a primary axis (200). The casted rubber dampeners (76, 78) are designed to absorb frontal impact or shock from obstructed road surfaces while a passenger is riding about on the vehicles (10) of the preferred embodiment of the present invention. Other such shock absorbent devices should include: conventional struts or shocks absorbers (not shown) as an alternative device to prevent an uncomfortable ride for the passenger or damage to the vehicles (10).

The fuselage's main support platform (26) (FIGS. 3-4, 7) provides a forged aluminum swiveling, sub-assembly bracket (28) secured to the rear underside of the main support platform (26), that enables the fuselage (24) to be operatively connected to the rear frame member (74). At the assembly holes (19*a*, 19*b*), support assembly screws (27*a*, 27*b*), inserted within the main support platform (26) that simultaneously pass through rear dampeners (29*a*, 29*b*) (FIG. 6, 12-13) wedged between underside of the main support platform (26) and the base of the sub-assembly bracket (28) having the assembly screws (27*a*, 27*b*), threaded into the bracket (28) which in turn, connects to the rear frame's upper cross member (95) via assembly screws (97*a*, 97*b*, 97*c*, 97*d*) securing the sub-assembly bracket (28) to the rear frame member (74).

A secondary connection between the rear frame's lower cross member (99) and the front frame's lower cross member (100) which overlaps the rear frame's lower cross member (99) and is secured via a pivot bolt (75), threaded into the rear frame's cross member (99) thus, operatively connecting the framing members. The full body panel (20) (FIG. 14) assembled to the frame system (70) having all drivetrain components attached thereof the frame system (70) provides a means of controlling direction, acceleration and braking of the vehicles (10) of the preferred embodiment of the present invention.

A rotatably mounted, aluminum alloy, drive pulley (60) (FIGS. 8, 12-13) secured to the rear end portion of the rear frame member (74) via a steel axial (61) with end nuts (71*a*, 71*b*), threaded at each end of axial (61) having an aluminum alloy, driven sprocket (49), attached to the pulleys face via a plurality of assembly screws (69). Drive pulley (60) provides teeth in base to drive a reinforced rubber, synchronous belt (68) which propels vehicle (10) on a road surface. The rear frame member (74) also, provides a second (smaller) aluminum alloy, guide pulley (62) rotatably mounted via a second steel axial (63) with end nuts (71*c*, 71*d*), threaded at each end of axial (63), secured to the lower portion of the rear frame member (74) and a final aluminum alloy, guide pulley (64) is rotatably mounted onto the front end portion of the front frame member (72) via a final steel axial (65) with end nuts (71*e*, 71*f*), threaded at each end of axial (65). A reinforced rubber, synchronous belt (68) providing teeth to mesh with the teeth within pulley (60) to enable maximum torque between belt (68) and a road surface, is assembled around all the pulleys encompassing the entire frame system (70) and drivetrain components thereof the wearable motorcycles (10), according to embodiments of the present invention.

An internal combustion engine (40) (FIGS. 12-13) secured to the rear frame member (74) which provides a (upper) central cross member (96) to support a first motor mount bracket (101), connected to the base of engine (40) via engine assembly bolts (103*a*, 103*b*) having the opposite end of the motor mount bracket (101) secured between the (upper) central cross member (96) via motor mount assembly bolts (104*a*, 104*b*). The rear frame member (74) also provides a (lower) central cross member (98) to support a second motor mount bracket (102) connected also to the base of engine (40) via engine assembly bolts (103*c*, 103*d*) having the opposite end of the motor mount bracket (102) secured between the (lower) central cross member (98) via motor mount assembly (104*c*, 104*d*). The installation of engine (40) onto the rear frame member (74) enables the engine to turn on the same pivot axis (210) as the rear frame member (74) when a passenger wearing the units executes a turning maneuver, using the full body panel (20) of the vehicles (10).

Engine (40) is equipped with a centrifugal clutch (47) (FIGS. 12-13) housed inside of a drumsprocket (48) which is installed to the crankshaft end via a crankshaft end nut (106). The drumsprocket (48) supports an endless steel, roller chain (110) which encompasses the drive sprocket structured on the drum portion of the drumsprocket (48) and the rear driven sprocket (49) that is assembled to the face of the rear drive pulley (60), installed to the rear frame member (74) which under the rotational movement generated by engine (40) thus, transmitting rotational movement onto the rubber, synchronous belt (68), that in turn, rotates around the entire frame assembly and components thereof, propelling the vehicle (10) about on a road surface.

A first (right) upper, roller guide bearing (105*a*) (FIG. 7, 12-13) is threaded into the rear frame's upper cross member (95) near the leading end of the upper cross member and is positioned with a minimum clearance of ⅛" from the sidewall of the rubber, synchronous belt (68) in which the upper, roller guide bearing (105*a*) remains motionless until a passenger changes the belt's axis and the belt's sidewall comes into contact with the roller guide bearing (105*a*) at which gives rotational movement, generated from the belt's rotational movement to the bearing (105*a*), simultaneously causing the rubber, synchronous belt (68) to slightly conform (arch) to the shape of the bearing to assist the turn ratio of the rear frame member (74). An equal and opposite reaction occurs when the second (left) upper, roller guide bearing (105*b*), threaded into the rear frame's upper cross member (95) as well, yet to the opposite sidewall of the rubber, synchronous belt (68). For example a passenger riding in the vehicles (10), on a straight forward path, changes direction of the vehicles (10) by simultaneously pivoting the hip, legs and feet in the desired left or right direction of travel and the input is transmitted to the full body panels (20) and into the front frame member (72) which turns to the heading while the rear frame member (74) turns opposite of the front frame's heading, thus arching the synchronous belt (68) into the turn; similar to the operation of skis.

Figure 8:
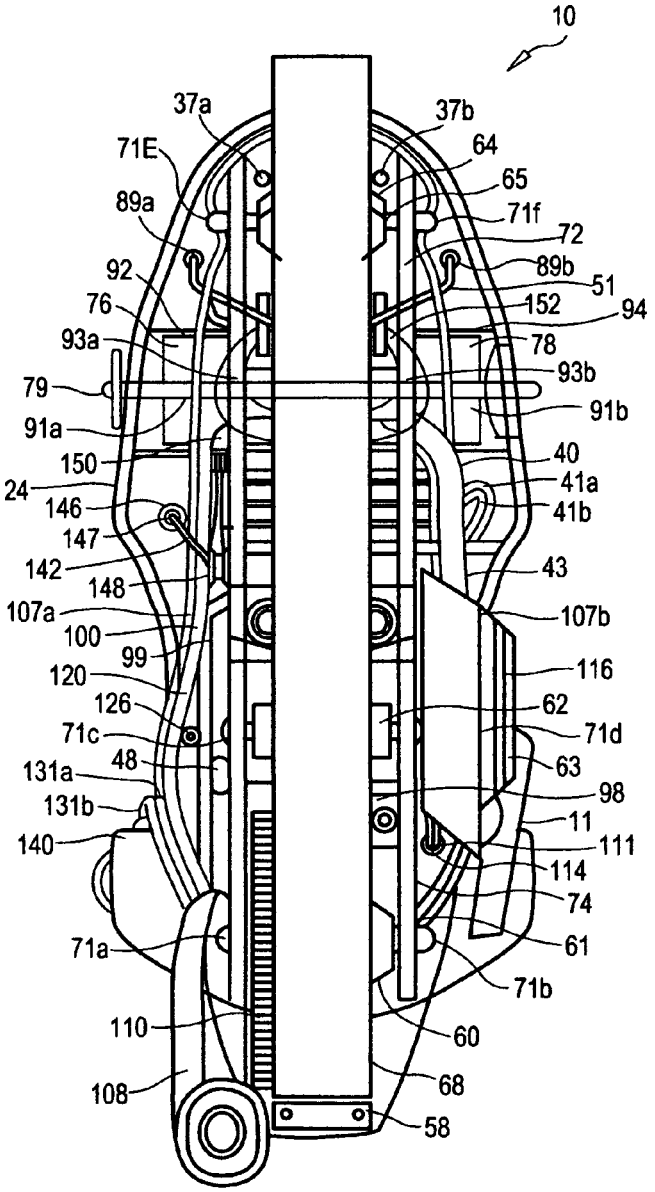
FIG. 8 is a bottom view of the present invention, showing the internal components and how the present invention functions, illustrated in FIGS. 1-7.
Figure 9:
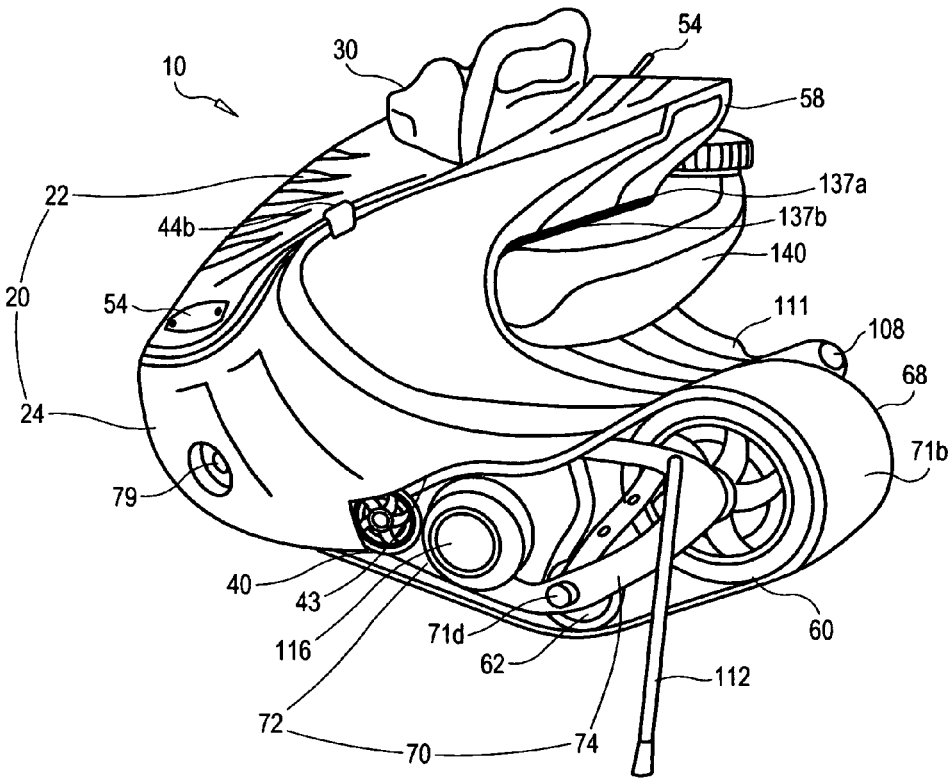
FIG. 9 is a rear perspective view of the present invention, illustrated in FIGS. 1-8.
Figure 10:
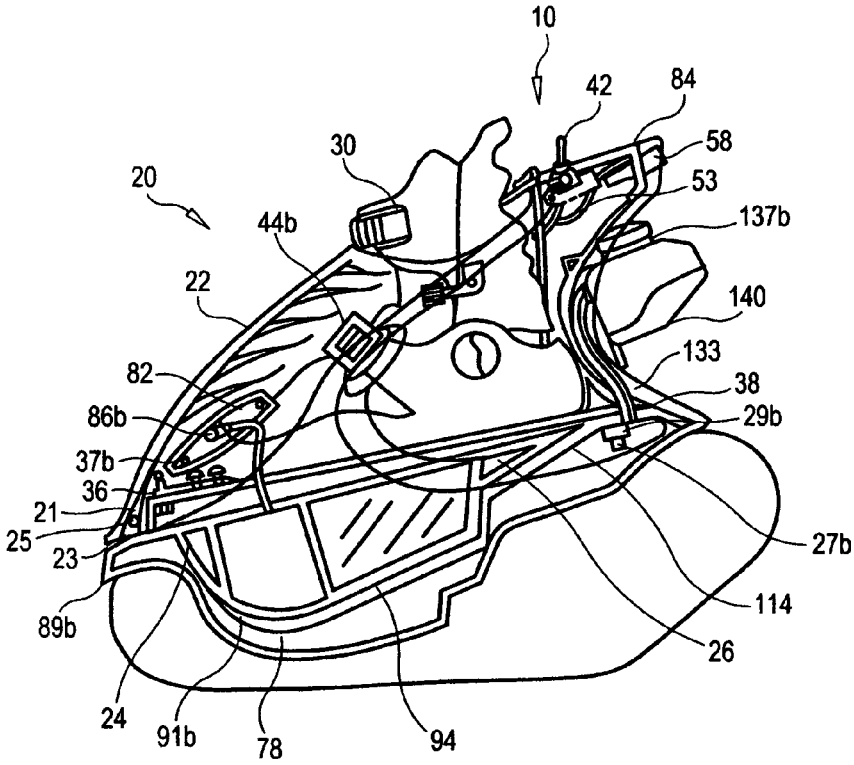
FIG. 10 illustrates a (left) elevational, cross section of the full body panel (20) and components thereof, without frame members and drivetrain components of the present invention.
Figure 11:
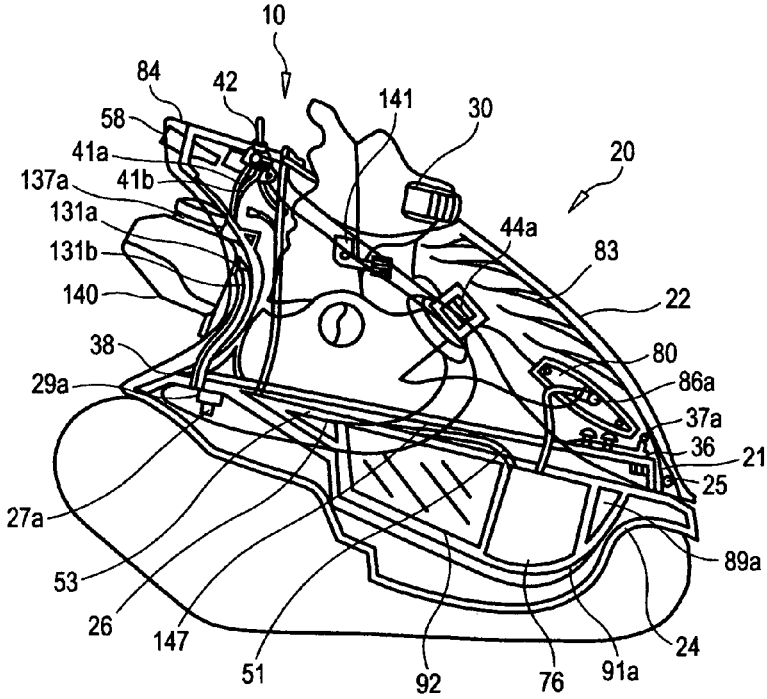
FIG. 11 illustrates a (right) elevational, cross section of the full body panel (20) and components thereof, without frame members and drivetrain components of the present invention.
Figure 12:
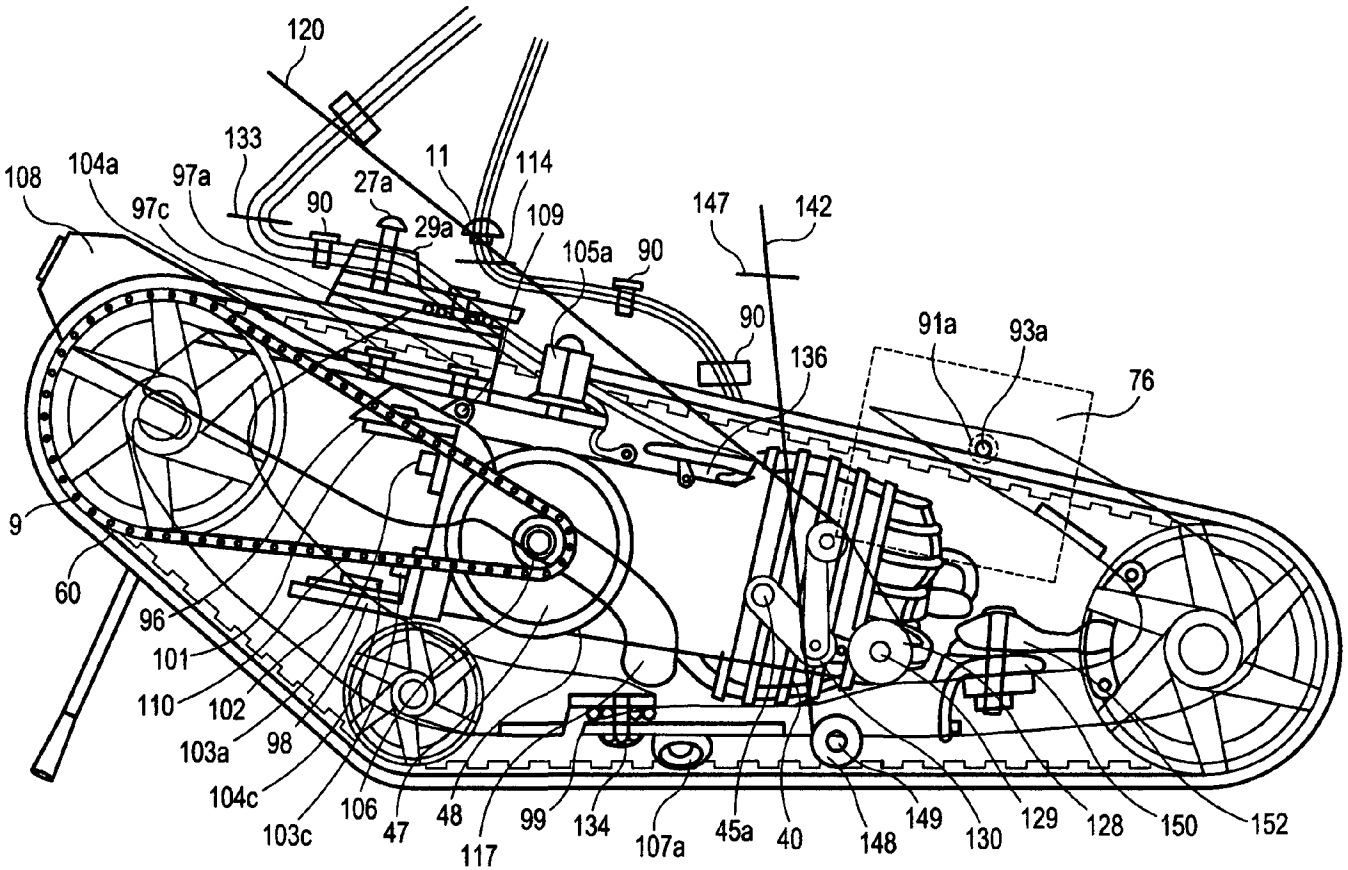
FIG. 12 illustrates a (right) elevational view of the frame system (70) and drive train components, without the full body panel (20) and components thereof, the preferred embodiment of the present invention; illustrated in (FIGS. 1-11).
Figure 13:
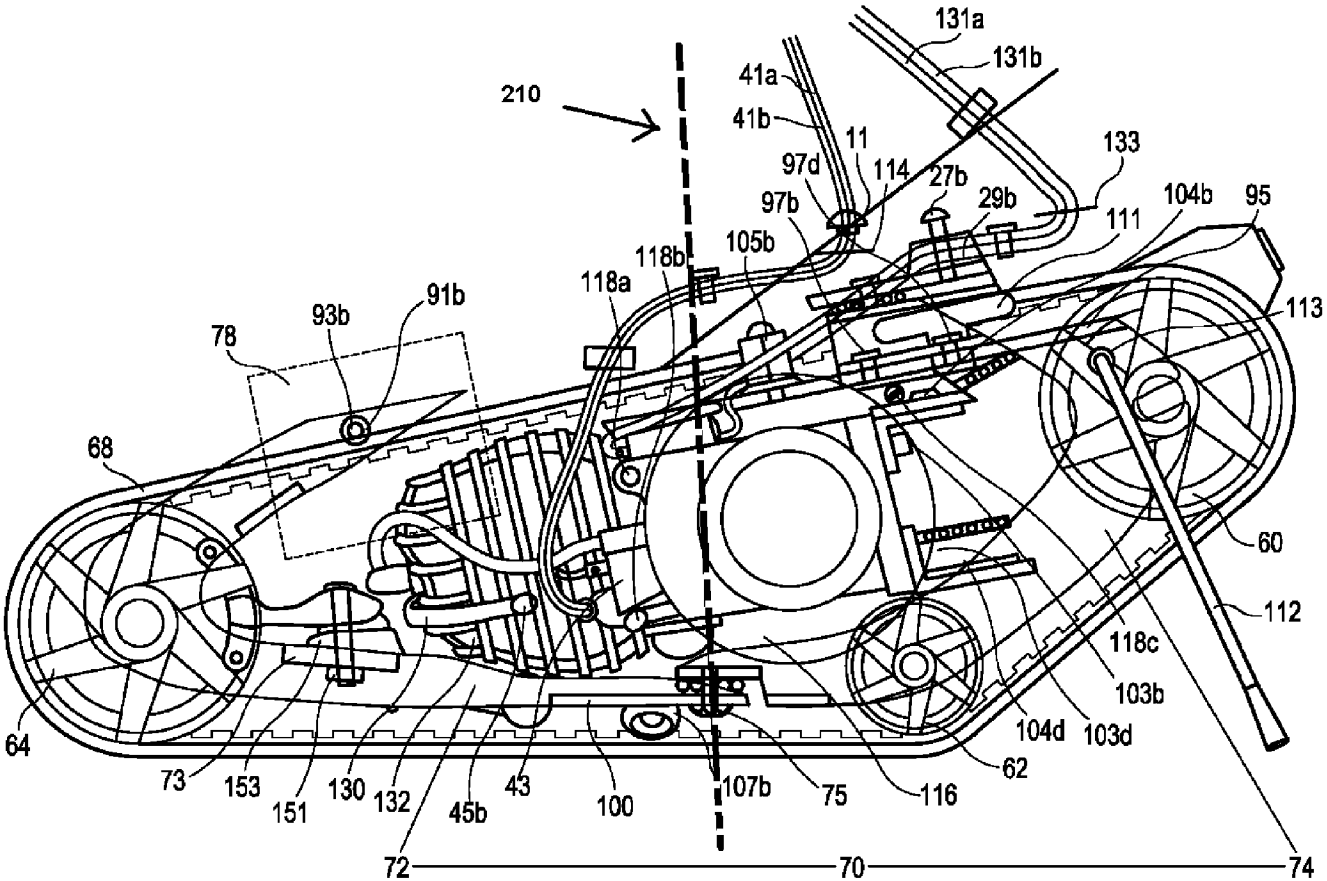
FIG. 13 illustrates a (left) elevational view of the frame system (70) and drive train components, without the full body panel (20) and components thereof, the preferred embodiment of the present invention; illustrated in (FIGS. 1-12).
Figure 14:
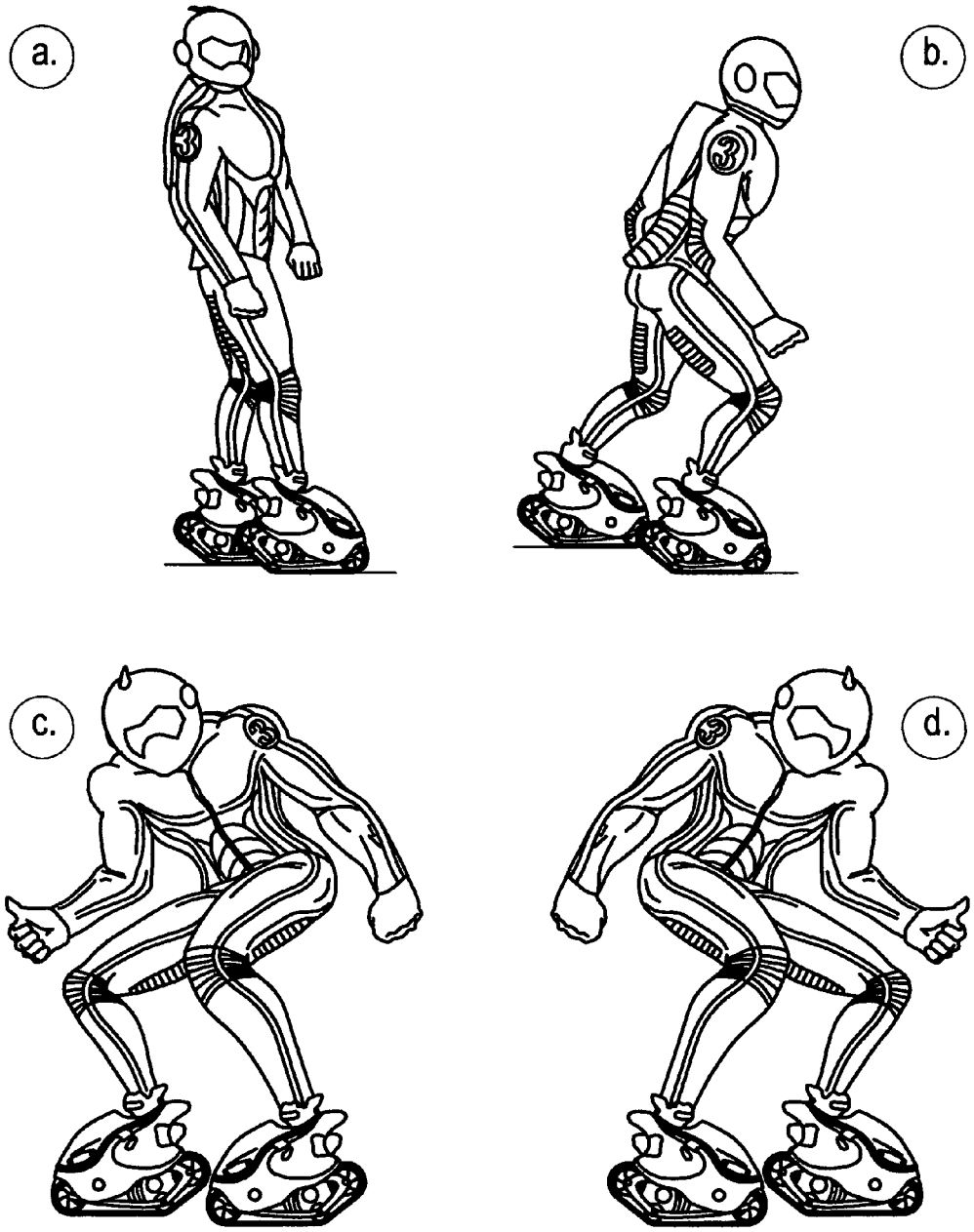
FIG. 14 are sequential illustrations, which depict a passenger performing basic operations of the wearable motorcycles (10) demonstrating postures; (A) starting/braking, position, (B) driving position, (C) right turn and (D) left turn postures, according to the preferred embodiment of the present invention.

Lower, roller guide bearing (107*a*) (right) and (107*b*) (left) are secure to the front frame's lower cross member (100) using all the same methodologies previously described with the upper, roller guide bearings (105*a*, 105*b*). However, the lower bearings are assembled on a 45 degree angle to the belt's sidewalls (FIG. 8).

On the right side of engine (40) (FIG. 12-13) exhaust pipe (108) extends from the exhaust port to the rear end portion of the rear frame member (74) and is secured to the exterior of the frame via exhaust bolt (109) and on the left side of the rear frame member (74) a retractable kickstand (112) is pivotally connected into the exterior of the rear frame member (74) via an end nut (113), threaded onto the end of the kickstand (112). The kickstand (112) is used during time periods at which the wearable motorcycle (10) aren't being used and the passenger deploys the kickstand (112) to support the vehicle's weight, upright, on a sufficient surface and when a passenger so desires to use the vehicle (10), the kickstand (112) retracts, upward, along side of the rear frame's exterior, as the user tilts the vehicle (10). To support the vehicles (10) on the kickstand (112), a passenger uses his or her hand to simply twist the pivotally mounted kickstand (112), enabling the kickstand's end to rest on the ground.

The left side of engine (40) (FIG. 1-4, 13) equipped with an embossed, rewind starter (116), secured over the flywheel (not shown) of the engine (40) and the rewind starter (116) is connected onto the crankcase (117) of the engine (40) via engine assembly bolts (118*a*, 118*b*, 118*c*), in this preferred embodiment of the present invention. However an electric push-button switch (not shown) connected to the ignition system (43) or a kickstarter application (not shown) can be adapted, as an alternative device, to start the vehicle (10). Although, the engine (40) is equipped with a rewind starter (116) in which must be pulled or jerked via a starter handle 111 by the user, operating the vehicle (10), however the vehicles will not start without first, turning on the killswitch (42) which is affixed onto the rear end portion of the fuselage (24) having lead wires (41*a*, 41*b*) connected to the killswitch (42) base and routed down the interior sidewall of the fuselage (24), out through an (small) inlet (114), milled within the base of the main support platform (26) and protected by a rubber grommet (11), pressed into the inlet (114), enabling the remainder of the wire leads (41*a*, 41*b*) to be partially secured to the underside of the main support platform (26) via plastic body clips (90) and is connected to the ignition system (43) which is equipped onto engine (40) of the vehicle (10).

A throttle assembly cable (120) (FIGS. 3-4, 7) connected to the back, upper portion of the left, plastic, support boot (30) via a threaded cable end (119), secured directly into the upper portion of the support boot (30) and having the throttle assembly cable (120) extend out the back of a port hole (121), milled through the fuselage (24). The throttle assembly cable (120) is looped halfway over a (small) conventional winch pulley (122) rotatably mounted to the infrastructure of the fuselage (24) via assembly stud (123), threaded to body portion and also, having the throttle assembly cable (120) rooted back inside of the interior of the fuselage (24), against the fuselage's right interior sidewall and encased within a cable housing (124), suspended via plastic body clips (90) to the interior and the cable housing (124), gradually, slopes on an angle towards an inlet (125), milled within the base of the main support platform (26), where the cable housing (124) rest inside a cable seat (126), pressed into the inlet (125), enabling the remaining portions of the throttle assembly cable (120) to be extended out of the underside of the main support platform (26) to a second (small) winch pulley (128), rotatably mounted to a throttle assembly bracket (130) via a second assembly stud (129) having the throttle assembly bracket (130) secured to the engine's cylinder head (132) via engine assembly bolts (45*a*, 45*b*), threaded in each side of the cylinder head (132). The throttle assembly cable (120) loops around the winch pulley (128) and is fastened to the throttle assembly (134), equipped on the carburetor (136) of engine (40). Fuel lines (131*a*, 131*b*), connected to the carburetor (136) are routed up to the underside of the main support platform (26) and secured to the main support platform (26) via plastic body clips (90) having the remaining portions of the fuel lines (131*a*, 131*b*) inserted through an inlet (133) milled through the rear end of the fuselage's infrastructure and the fuel lines are fed into a plastic fuel tank (140) secured to the rear end of the fuselage (24) via assembly bolts (137*a*, 137*b*), threaded into the fuselage's infrastructure.

The throttle assembly (134) (FIGS. 3-4, 14) engages each time a passenger leans his or her lower leg and ankle forward (crouching) in direction of travel which, in turn, places tension on the throttle assembly cable (120), hence pulling the throttle assembly (134) open, causing fuel (gasoline) to flood into the carburetor (136) that's gravitationally fed from the fuel tank (140), thus ignited by the engine (40) to which then generates rotational movement to the drivetrain components, propelling the wearable motorcycles (10) on a road surface and a passenger decelerates the vehicle by returning to the initial upright posture which simultaneously engages the brake mechanism (150) to slow or stop the vehicles (10) of the preferred embodiment.

Another aspect the operative plastic left support boot (30) (FIG. 3-4, 14) provides by using the backward and forward lateral motion of the upper portion of the support boot (30) is braking of the vehicle (10). A brake cable (142), connected to the right side front edge of the upper support portion of the boot (30) via a cable end bracket (141) riveted onto the boot (30) having the brake cable (142) extending forward of the upper support portion and looped halfway over a third (small) winch pulley (144), rotatably mounted to the right interior sidewall of the fuselage (24) via a third assembly stud (143), threaded into the interior and having the brake cable (142) routed downward from the winch pulley (144) and inserted within a brake cable housing (145) secured to the right, interior sidewall of the fuselage (24) via plastic body clips (90). The brake cable housing (145) continues a route down the sidewall of the fuselage (24) until resting inside a cable seat (146), pressed into an inlet (147) milled through the base of the main support platform (26) and having the remaining portions of the brake cable (142) protrude out of the underside of the main support platform (26) on a route to a fourth and final (small) winch pulley (148), rotatably mounted to the right, lower portion of the front frame member (72) via a fourth and final assembly stud (149), threaded into the frame member (72). The brake cable (142) is looped halfway under the winch pulley (148). The brake cable (142) extends from the winch pulley (148) and is connected to the pressure lever (150) of the brake mechanism (152) secured to the front frame's lower cross member (73) via an end nut (151) screwed to the brake's assembilation stud (153), protruding from the underside of the cross member (73).

The brake mechanism (152) (FIGS. 3-4, 14) engages each time a passenger returns to his or her initial upright posture which places tension on the brake cable (142) and pulls the pressure lever (150), causing the brake mechanism (152) to slow down or stop the rotational movement of the leading guide pulley (64) and the latter of the drivetrain components, assembled to the wearable motorcycles (10) of this embodiment of the present invention.

The wearable motorcycles (10) of the preferred embodiments of the present invention is bias to hand-held control devices for the brake mechanisms or hand-held control devices to accelerate the vehicles (10) in this embodiment, however devices possessing such capacities can be adapted as an alternative component to control the vehicles (10) of the preferred embodiment of the present invention (now shown).

The foregoing description conveys the best understanding of the objectives and advantages of the present invention. Different embodiments may be made of the invention concept of the invention. It is to be understood that all matter disclosed herein is to be interpreted merely as illustrative, and not in a limiting sense.

I claim:

1. A compact motorcycle, for attachment to a foot of a rider, comprising:

a support boot;

a main support platform secured to said support boot via a heel cleat and a toe cleat;

a primary axis running the length of said main support platform, extending inline between said heel cleat and said toe cleat;

a frame system attached under said main support platform, said frame system comprising:

a front frame member disposed along said primary axis and fixedly connected to said main support platform;

a rear frame member disposed along said primary axis and pivotally connected to said main support platform; and a pivot pin defining a vertical pivot axis and pivotally coupling said front frame member to said rear frame member such that said rear frame member is rotatable about said pivot axis;

a system of pulleys attached to said frame system and comprising:

a drive pulley;

a second guide pulley smaller than said drive pulley; and a final guide pulley;

a rubber track disposed around and in communication with said drive pulley, said second smaller guide pulley, and said final guide pulley of said system of pulleys;

wherein said rubber track is positioned at non-right angles under said frame system and is adapted to reconfigure in shape and position relative to said front and rear frame members during a steering maneuver in which the rear frame member rotates about the pivot axis relative to the front frame member;

an engine attached to said rear frame member and in communication with said system of pulleys;

a fuel tank attached to said frame system and in communication with said engine;

an exhaust pipe attached to said engine;

wherein said exhaust pipe directs exhaust from said engine away from said support boot;

a dampener attached to said frame system to absorb impacts;

a throttle assembly attached to said engine and to said support boot, and entirely contained on and/or within said compact motorcycle; and a brake mechanism attached to said system of pulleys.

2. The compact motorcycle of claim 1, wherein said support boot is attached to said main support platform such that said support boot is angled down at a front of said support boot.

3. The compact motorcycle of claim 1, wherein said system of pulleys is lower toward a front of said main support platform than toward a back of said main support platform.

* * * * *